US005089931A

United States Patent [19]

Thuries et al.

[11] Patent Number: 5,089,931

[45] Date of Patent: Feb. 18, 1992

[54] SAFETY DEVICE FOR ELECTRICAL APPARATUS CONTAINING A DIELECTRIC GAS, IN PARTICULAR CIRCUIT BREAKERS OR VOLTAGE-DROPPERS FOR MEASUREMENT PURPOSES

[75] Inventors: Edmond Thuries, Meyzieu; Jean-Pierre Dupraz, Lyons; Jean-Paul Moncorge, Vaux en Velin; Jean-Marc Willième, La Mulatiere; Joseph Martin, Meyzieu; Yves Perrusset, Vaulx en Velin; Didier Taponat, Villeurbanne, all of France

[73] Assignee: GEC Alsthom SA, Paris, France

[21] Appl. No.: 476,239

[22] Filed: Feb. 7, 1990

[30] Foreign Application Priority Data

Feb. 7, 1989 [FR] France ..... 89 01538

[51] Int. Cl.[5] ..... H01H 47/24

[52] U.S. Cl. ..... 361/174; 361/1; 361/117; 361/175; 200/148 R

[58] Field of Search ..... 361/1, 174, 175, 55, 361/117; 219/212, 10.55 R; 250/206; 315/151, 159; 200/148 R

[56] References Cited

U.S. PATENT DOCUMENTS

| | | | |
|---|---|---|---|
| 3,719,867 | 3/1973 | Meier | 361/121 |
| 4,001,651 | 1/1977 | Kershaw, Jr. | 361/117 |
| 4,463,405 | 6/1984 | Koch et al. | 361/135 |
| 4,599,052 | 6/1986 | Langen et al. | 417/413 |
| 4,685,018 | 8/1987 | Tada et al. | 361/1 |
| 4,685,021 | 8/1987 | Kortschinski et al. | 361/42 |
| 4,709,291 | 11/1987 | Eggert et al. | 361/2 |
| 4,734,823 | 3/1988 | Cunningham | 361/125 |
| 4,839,767 | 6/1989 | Yoshioka et al. | 361/42 |

FOREIGN PATENT DOCUMENTS

| | | |
|---|---|---|
| 1079733 | 4/1960 | Fed. Rep. of Germany . |
| 3238000 | 12/1983 | Fed. Rep. of Germany . |
| 2388391 | 11/1978 | France . |
| 2505051 | 11/1982 | France . |
| 2011184 | 7/1979 | United Kingdom . |

*Primary Examiner*—Peter S. Wong
*Assistant Examiner*—Ben M. Davidson
*Attorney, Agent, or Firm*—Sughrue, Mion, Zinn Macpeak & Seas

[57] ABSTRACT

A safety device for an electrical apparatus comprising an enclosure filled with gas under pressure, the safety device comprising first means for detecting the appearance of an arc inside the enclosure, and second means controlled by the first means to establish a path for the gas through the enclosure when the first means has detected an arc for a given length of time.

14 Claims, 3 Drawing Sheets

SAFETY DEVICE FOR ELECTRICAL APPARATUS CONTAINING A DIELECTRIC GAS, IN PARTICULAR CIRCUIT BREAKERS OR VOLTAGE-DROPPERS FOR MEASUREMENT PURPOSES

The invention relates to a safety device for an enclosure containing electrical apparatus and an insulating dielectric gas, e.g. sulfur hexafluoride, at a pressure of a few bars.

BACKGROUND OF THE INVENTION

The invention is particularly applicable to cases where the enclosure is made of porcelain, e.g. vessels for circuit breakers. In enclosures of this type, there exist safety members that operate in the event of accidental excess pressure.

These members are either rated valves, or else membranes, capsules or plates which, when the pressure inside the enclosure reaches a given threshold, tear or break, thereby allowing the gas to expand to the outside and thus avoiding any danger of the enclosure being destroyed.

The increase in pressure inside the enclosure against which protection is required is due to an internal arc. Depending on the intensity of the arc, the time required for the pressure to reach the above-mentioned threshold value may vary from a few hundredths of a second for a high intensity arc to several seconds for a low intensity arc. When the time is relatively long, it is possible to avoid major damage to the active portions of the apparatus by using additional means to act quickly to tear the membrane. That is the object of the present invention.

SUMMARY OF THE INVENTION

The present invention provides a safety device for an electrical apparatus comprising an enclosure filled with gas under pressure, the safety device comprising first means for detecting the appearance of an arc inside said enclosure, and second means controlled by said first means to establish a path for the gas through said enclosure when the first means has detected an arc for a given length of time.

In a first embodiment, the first means is a photo-generator sensitive to the light of the arc, e.g. a photo cell or a photo-voltaic element.

Advantageously, the said photo-generator is placed outside the said enclosure, looking through a window in the wall thereof.

When the first means is a photo-generator, the second means is a striker comprising a striker rod, a spring for operating said rod, a permanent magnet holding said rod, and a control winding powered from said first means, said rod being placed to strike a breakable portion of the wall of said enclosure.

In a variant, the second means is a solenoid having a core disposed to strike a breakable portion of the wall of said enclosure. In another variant, the second means is a solenoid having a core which constitutes a retractable abutment for retaining a flyweight under urging from a spring and placed ready to strike a breakable portion of the wall of said enclosure.

In a second embodiment, the first means is constituted by means sensitive to the heat given off by the arc.

In an embodiment, the first means is a fuse.

In a variant, the first means is a shape-memory element.

The second means is advantageously a flyweight actuated by an energy-storing spring whose release is tripped by the change in said second means due to the effect of heat, the said flyweight breaking the breakable portion of the wall of said enclosure.

BRIEF DESCRIPTION OF THE DRAWINGS

Embodiments of the invention are described by way of example with reference to the accompanying drawings, in which.

DETAILED DESCRIPTION

Figure 1:
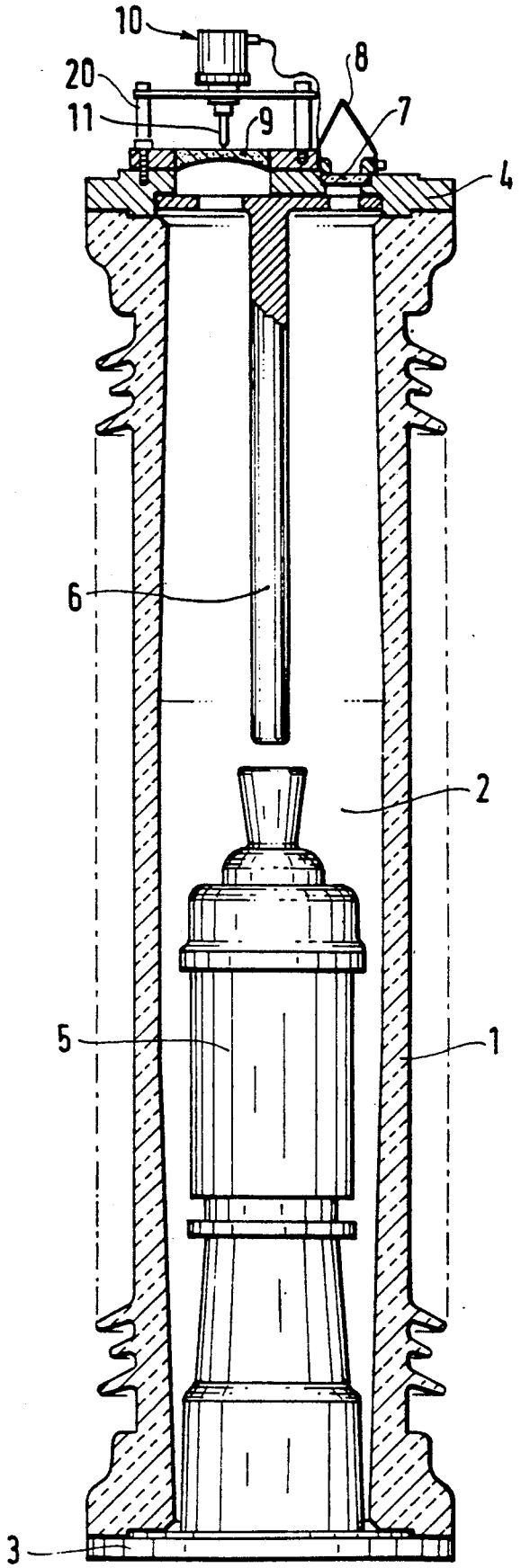
FIG. 1 is an axial cross-section view of a circuit breaker's current-interrupting chamber fitted with a first embodiment of a device of the invention.
Figure 2:
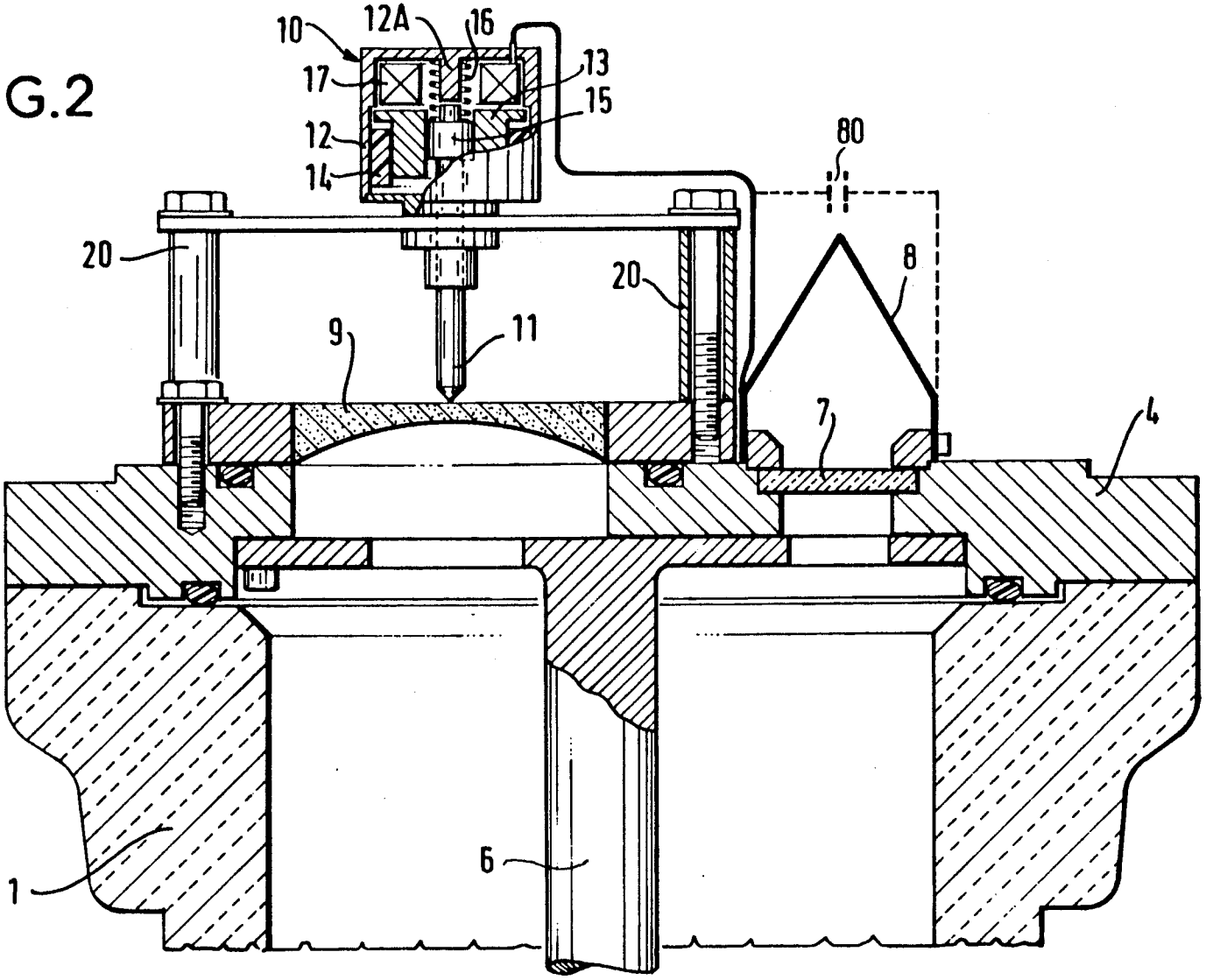
FIG. 2 is a view on a larger scale of a portion of FIG. 1.

FIG. 1 is a diagram of the current-interrupting chamber of a circuit breaker. This chamber comprises a ceramic vessel 1 delimiting a volume 2 filled with a dielectric gas such as sulfur hexafluoride, at a pressure of several bars.

The chamber has two end plates 3 and 4. Reference 6 designates the member supporting the fixed contacts and reference 5 designates the member supporting the moving contacts and the blast nozzle. An operating rod (not shown) passes through the end plate 3.

The end plate 4 is provided with a first window which is closed by a translucent or transparent element 7 having a photo-generator 8 placed looking through the window (preferably outside the chamber) and suitable for delivering electrical current when it receives light through the window 7. The photo-generator may be a photoelectric cell or a photo-voltaic element.

End plate 4 has a second window 9 which is closed by a breakable element such as a rupture plate, e.g. made of metal or sintered material based on iron or graphite.

Such rupture parts are well known in the electrical industry.

Rods 20 fix an electromagnetic striker on the end plate 4. Such a striker is described in European patent No. 0 107 167 filed Oct. 18, 1983, in the name of the present Applicant.

It comprises a soft iron vessel 12 including an internal pillar 12A and containing a magnetic circuit 13, a cylindrical permanent magnet 14 magnetized radially, a magnetic core 15 extended by a striker rod 11, a spring 16, and a winding 17.

When the striker is primed, the spring is compressed since the core 15 and the pillar 13 are magnetically attracted to each other and the magnetic force holding them together is greater than the spring force urging them apart.

If a current flows through the winding in a direction such as to oppose the flux of the permanent magnet, the force holding them together is reduced and the spring is free to drive the striker.

In the application described, the photo-generator element is electrically connected to the winding.

The device operates as follows:

When the circuit breaker interrupts a current, an arc is struck between its contacts, and is then rapidly extinguished (e.g. after 10 milliseconds). This arc is seen by the photo-generator which delivers current to the winding. However, given the short duration of the arc and the self-inductance of the winding, the ampere turns delivered are insufficient to cancel the flux of the striker's permanent magnet.

However, if an arc is struck and maintained within the chamber for a period of time longer than the arc interruption time (e.g. 100 ms), then the ampere turns created in the winding suffice to cause the striker to operate and break the rupture disk.

Operating accuracy can be further adjusted by associating the photo-generator with a timing filter, e.g. a capacitor 80 connected across its terminals.

The striker used in the above embodiment is very sensitive and responds to the few milliwatts that a photo cell or photo-voltaic element provide.

Figure 3:
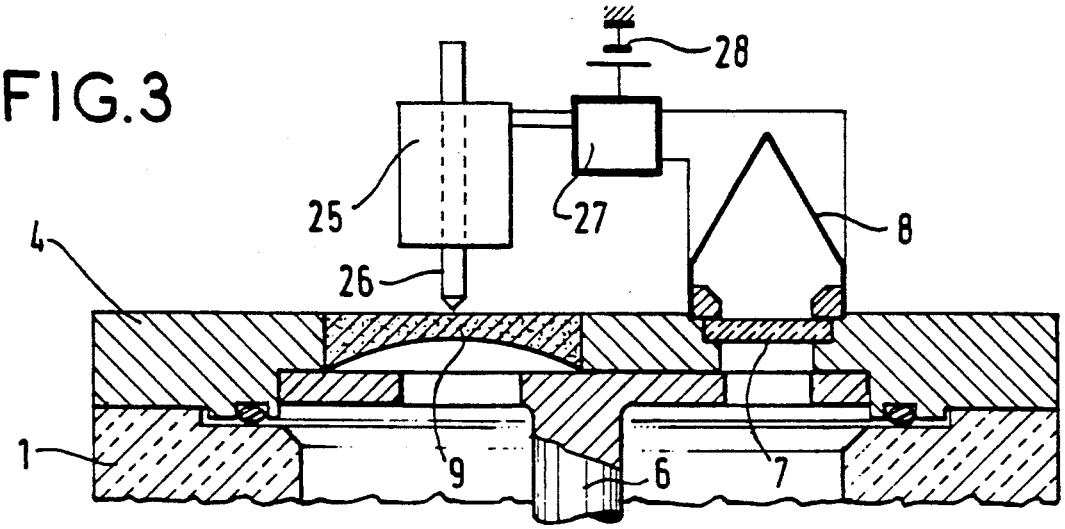
FIG. 3 is a diagram of a device having a solenoid and an auxiliary battery.

It is possible, instead, to use a more rudimentary electromechanical member, such as an electromagnet 25 having a core 26, as shown in FIG. 3, providing the photo-generator is connected to an electronic gate circuit 27 for allowing a larger-value current to pass, as delivered by an auxiliary source such as a battery 28.

Figure 4:
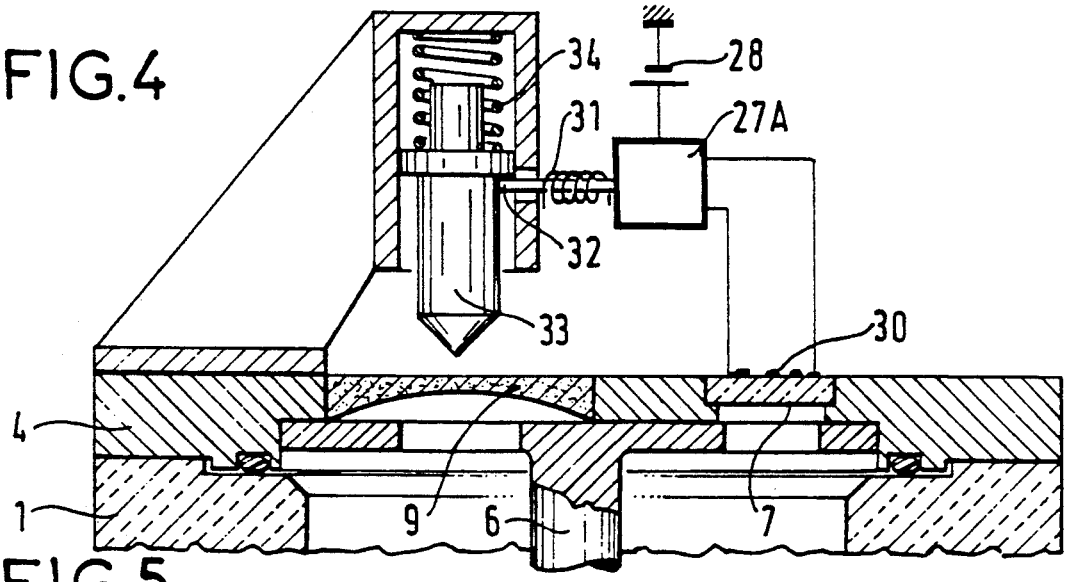
FIG. 4 is a diagrammatic view of a device having a spring and an auxiliary battery.

FIG. 4 shows an embodiment in which a photodetector such as a photoresistor 30 is connected to a gate circuit 27A associated with a battery 28 and serves to feed a small solenoid 31 whose core 32 constitutes a retaining abutment for a flyweight striker 33 under thrust from a spring 34.

Since the self-inductance of the small solenoid 31 is insufficient for ensuring an adequate time delay, the electronic circuit 27A should include time delay means.

It may be observed that the photoresistor is placed on the surface of the window 7 in this case. In a variant, it could be placed inside the enclosure, which would make it possible to omit providing a window such as 7.

In another variant, the photoresistor is replaced by a photodiode likewise associated with a power supply and a gate circuit including time delay means and controlling a striker or a solenoid.

In a variant embodiment, the means for opening a passage for the gas inside the enclosure in the event of a long-duration arc, is an explosive charge which is fired under control of a detonator having time delay means and itself tripped by the photo-generator.

In the description above, a striker element causes a rupture member placed in the wall to be broken of the enclosure.

For circuit breakers having a ceramic cylindrical vessel, the rupture member will always be placed on one of the closing end plates of the vessel, said plate being considered in the context of the present invention as forming a portion of the wall of the vessel.

With a metal-clad installation, there is greater freedom in positioning the rupture member.

In another embodiment of the invention, the first element is sensitive to the heat given off by the arc. This element may be a fuse or a shape-memory element. It is then essential for the element to be placed inside the vessel.

Figure 5:
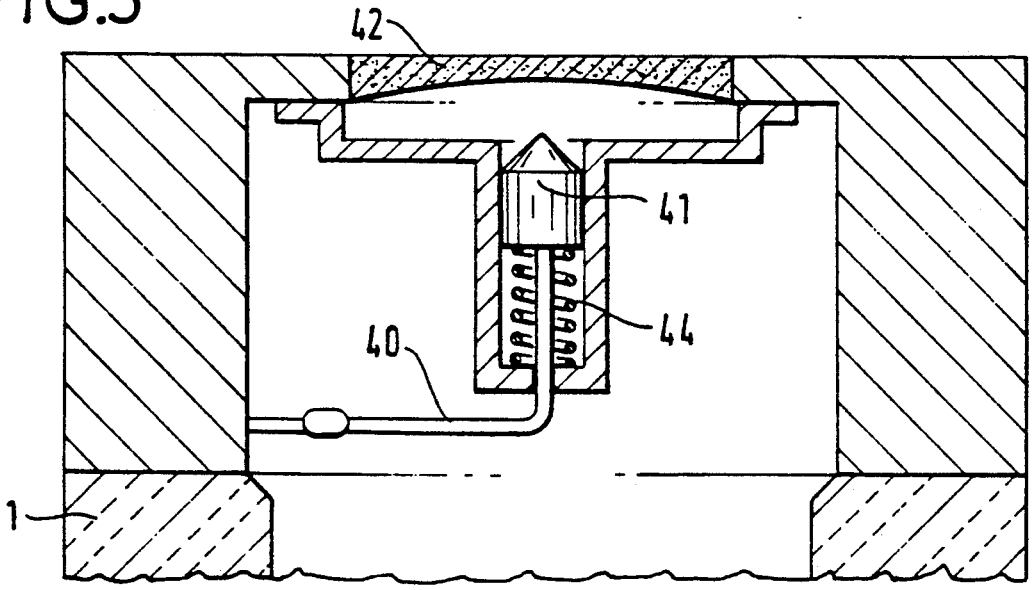
FIG. 5 is a diagrammatic view of a device having a fuse.

In the diagram of FIG. 5, fuse wire 40 retains a flyweight striker 41, striker 41 against the action of a spring 44. The flyweight is placed ready to strike a rupture member 42 in the wall of the enclosure. When the device is applied to a circuit breaker, the fuse is calibrated to melt only if the arc produces a rise in temperature greater than that which occurs during normal operation of the apparatus.

In a variant, the spring may be replaced by a member which deforms under the action of heat, e.g. a shape-memory member, disposed so that on changing shape it releases a flyweight which is then thrust by a spring to break a breakable portion of the wall of said enclosure.

We claim:

1. A safety device for an electrical apparatus comprising an enclosure filled with gas under pressure, said enclosure having a wall, the safety device comprising first means for optically detecting the appearance of an arc inside said enclosure, and second means operatively connected to said first means to penetrate said enclosure wall to establish a path for the gas to escape from said enclosure when the first means has optically detected an arc for a given length of time.

2. A safety device according to claim 1, wherein the first means is a photo-generator sensitive to the light of the arc.

3. A safety device according to claim 2, wherein said photo-generator is placed outside said enclosure aligned with a transparent window in the wall thereof.

4. A safety device according to claim 3, wherein the photo-generator is operatively connected to a time delay filter including a capacitor.

5. A safety device according to claim 1, wherein the first means controls a gate circuit for an auxiliary battery.

6. A safety device according to claim 1, wherein the first means is a photoresistor.

7. A safety device according to claim 1, wherein said photodetector is associated with a power supply and with a gate circuit including time delay means.

8. A safety device according to claim 1, wherein the second means is a striker comprising a striker rod, a spring biasing said striker rod, a permanent magnet holding said striker rod against said biasing spring and a control winding powered from said first means, and means for positioning said rod to strike a breakable portion of the wall of said enclosure.

9. A safety device according to claim 1, wherein the second means is a solenoid having an axially movable core disposed in a position to strike a breakable portion of the wall of said enclosure upon energization of said solenoid.

10. A safety device according to claim 1, wherein the second means is a solenoid having a core which constitutes a retractable abutment retaining a flyweight striker under a spring bias and placed in a position to strike a breakable portion of the wall of said enclosure.

11. A safety device according to claim 1, wherein the first means is constituted by means sensitive to heat given off by an arc, and where said first means is placed inside said enclosure.

12. A safety device according to claim 11, wherein the first means is a fuse.

13. A safety device according to claim 12, wherein the second means is a flyweight striker positioned in proximity to a breakable portion of the wall of the enclosure and displaceable by means of a spring biasing said flyweight striker towards said breakable portion of the wall, and means for releasing the flyweight striker by a change in the state of said fuse.

14. A safety device according to claim 1, wherein said first means is a photodiode.

* * * * *